United States Patent [19]

Groenendaal, Jr. et al.

[11] Patent Number: 4,915,581

[45] Date of Patent: Apr. 10, 1990

[54] STEAM TURBINE WITH IMPROVED INNER CYLINDER

[75] Inventors: John C. Groenendaal, Jr., Winter Springs; Mary W. Schleider, Orlando, both of Fla.

[73] Assignee: Westinghouse Electric Corp., Pittsburgh, Pa.

[21] Appl. No.: 293,161

[22] Filed: Jan. 3, 1989

[51] Int. Cl.[4] ..... F01D 25/26

[52] U.S. Cl. ..... 415/213.1; 415/108; 415/135; 415/169.4; 248/901

[58] Field of Search ..... 415/213.1, 108, 169.1, 415/169.4, 119, 134, 135, 93, 101, 103; 248/603, 604, 901

[56] References Cited

U.S. PATENT DOCUMENTS

| | | | |
|---|---|---|---|
| 2,929,218 | 3/1960 | Yates | 415/135 |
| 3,545,706 | 12/1970 | Harshman | 248/604 |
| 3,773,431 | 11/1973 | Bellati et al. | 415/108 |
| 3,973,870 | 8/1976 | Desai | 415/169.4 |
| 3,982,849 | 9/1976 | Bernasconi et al. | 415/101 |
| 4,029,432 | 6/1977 | Meylan et al. | 415/108 |
| 4,102,598 | 7/1978 | Stock et al. | 415/135 |
| 4,232,993 | 11/1980 | Ikeda et al. | 415/134 |

FOREIGN PATENT DOCUMENTS

| | | | |
|---|---|---|---|
| 125301 | 9/1980 | Japan | 415/93 |

*Primary Examiner*—Robert E. Garrett
*Assistant Examiner*—John T. Kwon

[57] ABSTRACT

A steam turbine including a casing structure which has an outer cylinder and the inner cylinder, a blade support ring, a plurality of stationary blades arranged in a number of annularly-shaped rows along the length of the turbine on the ring, and a rotor with a plurality of rotating blades arranged in a number of annularly-shaped rows along the length thereof and attached thereto, also includes improved structure providing integrated casing alignment and steam extraction. The improved structure, in combination with the conventional extraction steam piping that exits from the inner cylinder, includes a load plate arranged perpendicularly to the extraction steam piping, one or more flex plates attached between the load plate and the inner cylinder, a plurality of alignment lugs attached in predetermined positions about the load plate, and a plurality of stiffening gussets attached both to the alignment lugs and the load plate.

17 Claims, 3 Drawing Sheets

STEAM TURBINE WITH IMPROVED INNER CYLINDER

BACKGROUND OF THE INVENTION

1. Field of the Invention

The present invention is related generally to steam turbines, and more particularly to an improved apparatus and method of fabricating same which provides integrated casing alignment and steam extraction for retrofit inner cylinders in such steam turbines.

2. Statement of the Prior Art

In prior art steam turbines, for example, those steam turbines which were manufactured by Westinghouse Electric Corporation and predated the "BB" (i.e., building block) era, the original inner cylinders or casings were most often made of cast iron or cast grey iron, and sometimes cast steel. These casing designs of such older steam turbines had a bulky, costly and rather elaborate manifold structure, incorporated in the inner cylinder base, which routed not only the extraction steam flow, but also moisture removal flow in the cases of "non-reheat" units, from both ends of a double flow low pressure blade path to a single chamber to which the extraction steam piping or moisture removal vent piping was connected.

These known manifold structures also contained lugs at each end and at each side in order to accommodate for alignment loads between the outer and inner cylinders of the turbine. Most typically, such alignment loads could occur due to differential friction, pressure imbalance, inlet piping reactions, and other disturbances including seismic events. As a result, the above described cast construction most readily accommodated the complex shapes that were necessitated by the known manifold structures.

It has since been discovered that the original inner casings of such steam turbines also did not remove a sufficient amount of moisture from their blade paths. This remaining moisture, in turn, lead to heavy erosion damage both to the stationary parts of the turbine and to the rotating parts thereof. Such damage necessitated costly repairs and often required the use of stainless steel liners throughout the damaged turbines' blade path.

SUMMARY OF THE INVENTION

Accordingly, it is a general object of the present invention to provide an improved steam turbine. More particularly, it is an object of the present invention to provide an improved inner casing structure and method of fabricating same which is simple and inexpensive to construct.

It is another object of the present invention to provide an improved apparatus and method of fabricating same which promotes alignment between the inner and outer casings of a steam turbine.

It is yet another object of the present invention to provide an improved apparatus and method of fabricating same which promotes steam extraction for retrofit inner cylinders in such steam turbines.

It is a further object of the present invention to provide an improved apparatus and method of fabricating same which provides for integrated casing alignment and steam extraction for retrofit inner cylinders in such steam turbines.

It is a further still object of the present invention to provide an improved apparatus and method of fabricating same which promotes moisture removal in such steam turbines.

Briefly, the above and other objects according to the present invention are accomplished in a conventional steam turbine by improved structure located at the base of the turbine's inner cylinder. The turbine includes a casing structure which comprises an outer cylinder and the inner cylinder, means attached to the inner cylinder for supporting a plurality of stationary blades arranged in a number of annularly-shaped rows along the length of the turbine, and a rotor with a plurality of rotating blades arranged in a number of annularly-shaped rows along the length thereof and attached thereto.

In accordance with one important aspect of the invention, the improved structure comprises, in combination with the conventional extraction steam piping that exits from the inner cylinder, a load plate arranged perpendicularly to the extraction steam piping, one or more flex plates attached between the load plate and the inner cylinder, a plurality of alignment lugs attached in predetermined positions about the load plate, and a plurality of stiffening gussets attached both to the alignment lugs and the load plate. The improved structure may further comprise a flange fitted about the extraction steam piping and attached to the load plate. Each of the above described component parts of the improved structure are conveniently formed of carbon steel not only to facilitate construction of such improved structure, but also to minimize the expense involved therewith.

In accordance with another important aspect of the present invention, the improved structure for purposes of simplification in its manufacture and improvement in venting moisture removal steam includes a plurality of venting holes bored in the means attached to the inner cylinder for supporting the stationary blades. Such venting holes are arranged, in a preferred embodiment of the present invention, in two separate arrays uniformly distributed at each end of the turbine about the circumference of the stationary blade supporting means between preselected ones of the rows of rotating blades. The individual sizes and number of such venting hole are predetermined to provide a predetermined percentage amount of flow with respect to total stage flow. By venting the moisture removal steam to such selected points between the outer and inner cylinders, the improved structure not only prevents unnecessary erosion damage to the stationary and rotating parts of the steam turbine without the requirement of installing costly stainless steel liners, but also eliminates the complex manifold structure that was previously used in conventional steam turbines by venting moisture directly into the condenser situated beneath such steam turbines.

Other objects, advantages and novel features according to the present invention will become more apparent from the following detailed description thereof when considered in conjunction with the accompanying drawings wherein:

DETAILED DESCRIPTION OF THE INVENTION

Figure 1:
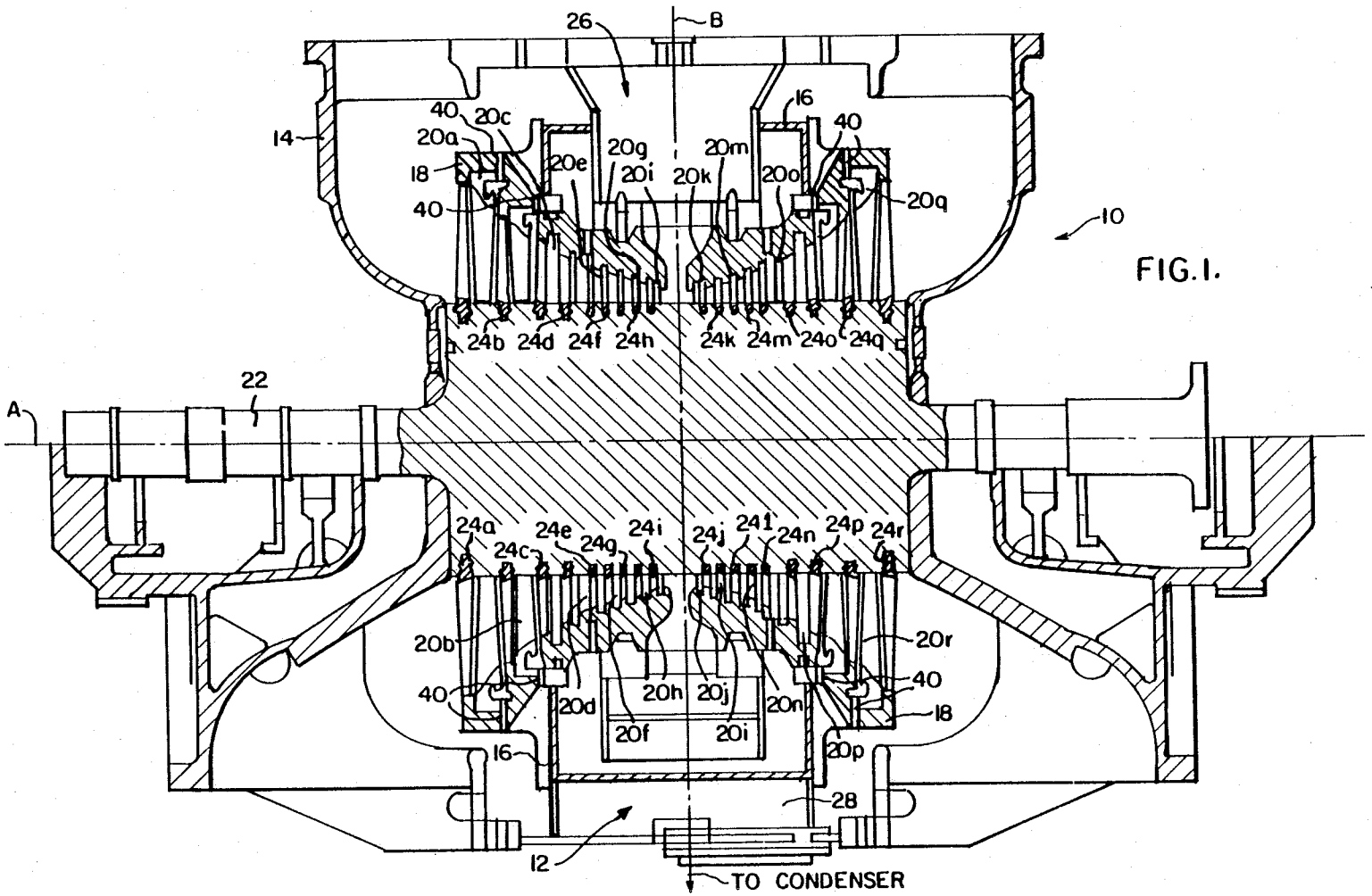
FIG. 1 diagrammatically illustrates a longitudinal section of a steam turbine which incorporates an improved structure according to the present invention.

Referring now to the drawings, wherein like numbers designate like or corresponding parts throughout each of the several views, there is shown in FIG. 1 a typical steam turbine 10 having incorporated therein an improved structure 12 which provides for integrated casing alignment and steam extraction in such a steam turbine 10.

As is conventional, the steam turbine 10 includes a casing structure comprising an outer cylinder 14 and an inner cylinder 16, means 18 attached to the inner cylinder 16 for supporting a plurality of stationary blades 20 arranged in a number of annularly-shaped rows (e.g., 20*a* through 20*r* as shown) along the length of the turbine 10, and a rotor 22 with a plurality of rotating blades 24 arranged in a number of annularly-shaped rows (e.g., 24*a* through 24*r* as shown) along the length of and attached to the rotor 22. Motive steam enters the steam turbine 10 at an inlet portion 26 thereof, and flows in a conventional manner through the multiple stages of the steam turbine 10 comprising respective pairs of the stationary blades 20 and rotating blades 24.

Further details regarding the operation of such steam turbines 10 are not deemed to be necessary in order to fully understand the present invention, since those operations are very well known.

It is also well known that means must be provided to maintain an alignment between the outer cylinder 14 and the inner cylinder 16 for various reasons such as differential friction, pressure imbalance, inlet piping reactions, and other disturbances including seismic events. Furthermore, because a central portion (i.e., proximate to the intersection of the rotor's centerline A and the inlet's centerline B) of the inner cylinder 16 is much hotter than those structures underlying the base structure 12 of the inner cylinder 16, the structure 12 must be capable of accounting for thermal expansion.

That is, the temperature at the central portion of the inner cylinder 16 is nearly equal to the temperature at the inlet portion 26 of the steam turbine 10, while the temperature of the structure underlying the base structure 12 of the inner cylinder 16 is more nearly approximated by the temperature of the condenser (not shown) below the steam turbine 10. As a result, the improved structure 12 in accordance with the present invention must not only be capable of handling alignment loads between the outer cylinder 14 and the inner cylinder 16, but also be capable of handling the thermal expansion which can be experienced therebetween.

Figure 3:
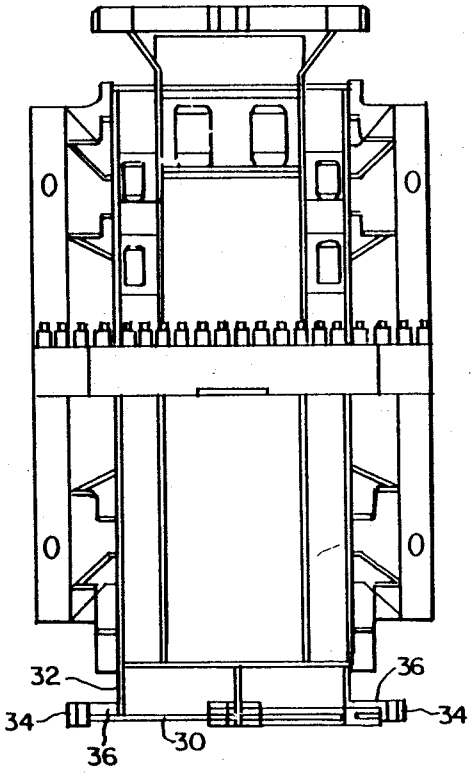
FIG. 3 illustrates a side view of the steam turbine illustrated in FIG. 1.
Figure 2:
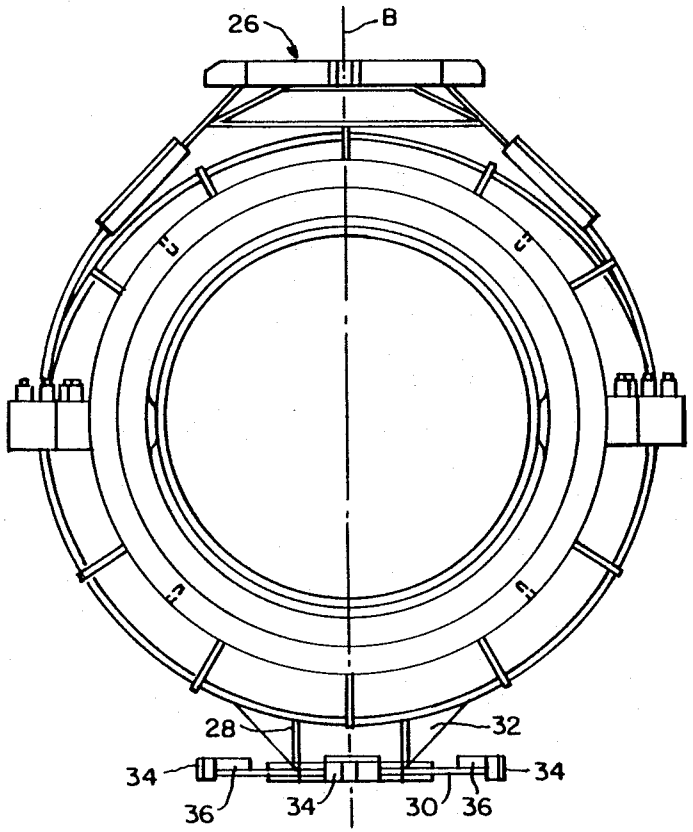
FIG. 2 shows an end view of the steam turbine illustrated in FIG. 1.
Figure 4:
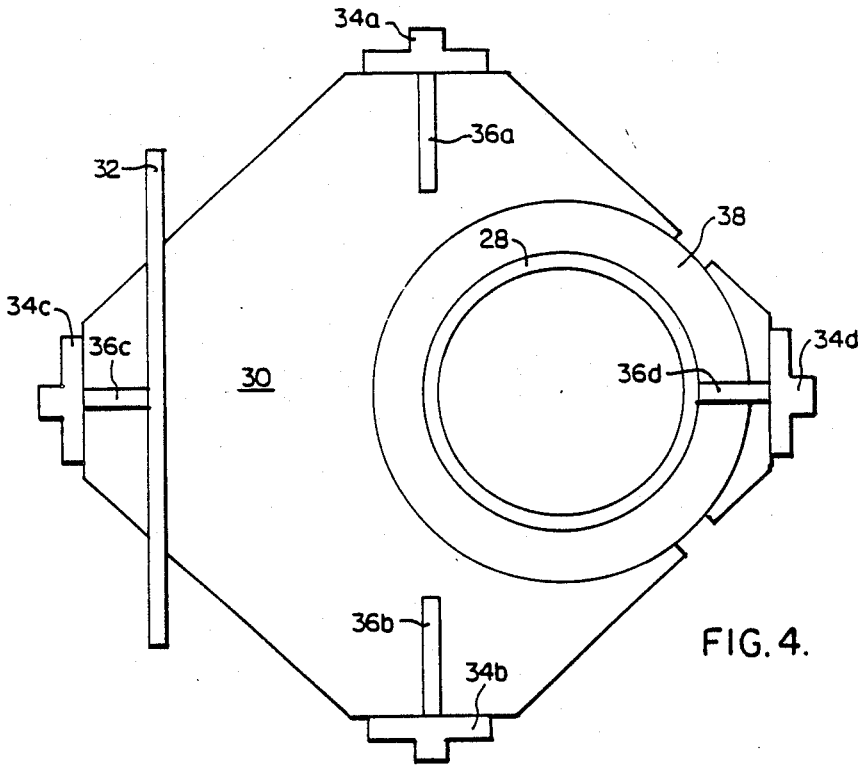
FIG. 4 shows in detail the improved structure according to the present invention as viewed from the bottom of the steam turbine illustrated in FIG. 1.

Accordingly, and referring now also to FIGS. 2–4, the improved structure 12 comprises in combination with the extraction steam piping 28 that exits from the inner cylinder 16, a load plate 30 arranged perpendicularly to the extraction steam piping 28, one or more flex plates 32 attached between the load plate 30 and the inner cylinder 16, a plurality of alignment lugs 34 attached in predetermined positions about the load plate 30, and a plurality of stiffening gussets 36 attached both to the alignment lugs 34 and the load plate 30.

In accordance with one important aspect of the present invention, the load plate 30, flex plates 32, alignment lugs 34, and stiffening gussets 36 each are preferably formed of carbon steel, and more preferably of pressure vessel quality carbon steel. The load plate 30, flex plates 32, and stiffening gussets 36 may be conveniently formed of rolled, pressure vessel quality carbon steel plate, while the alignment lugs 34 may be conveniently formed of carbon steel bar stock.

The load plate 30 is supported by attached to and encompasses the extraction steam piping 28. Such attachment may be conveniently accomplished by welding. In addition, the improved structure 12 may further comprise a flange 38 fitted about the extraction steam piping 28 and attached to the load plate 30 such as by welding.

As is shown in FIG. 1, the extraction steam piping 28 is located proximate to one end of the steam turbine 10. Therefore, the improved structure 12 that is shown in FIG. 1 only includes one flex plate 32 attached between the inner cylinder 16 and the load plate 30 at a position upon the load plate 30 opposite the extraction steam piping 28.

There are other known steam turbines, however, in which the extraction steam piping is nearly coaxially disposed with the inlet's centerline B, such that two flex plates 32 are required. In such cases, both flex plates 32 would be attached between the inner cylinder 16 and the load plate 30 to flank the extraction steam piping 28 at both ends of the load plate 30.

Whether there is one or two flex plates 32 attached between the inner cylinder 16 and the load plate 30, the attachment may be conveniently accomplished by welding.

In order to further support the alignment lugs 34, each alignment lug 34 has attached thereto a respective one of the stiffening gussets 36, such as by welding. Referring now more specifically to the detail of FIG. 4, it can be seen that the alignment lugs 34*a* and 34*b* that are located at the sides of the load plate 30 are merely supported by their respective stiffening gussets 36*a* and 36*b*. On the other hand, the alignment lugs 34*c* and 34*d* that are located at the ends of the load plate 30 are supported not only by their respective stiffening gussets 36*c* and 36*d*, but also by the flex plate 32 and the extraction steam piping 28 respectively. In cases where the extraction steam piping 28 is nearly coaxially disposed with the inlet's centerline B, such that two flex plates 32 are required, the end alignment lug 34*d* would also be supported by the additional flex plate 32. The reasons for such an arrangement will become readily apparent from the following description of alignment load transmission.

As discussed briefly herein above, alignment loads between the outer cylinder 14 and the inner cylinder 16 may occur for a number of reasons, such as differential friction, pressure imbalance, inlet piping reactions, and other disturbances including seismic events. Such loads in an axial direction are reacted first upon the alignment lugs 34*a* and 34*b*, and are subsequently transmitted, in turn, through the load plate 30, extraction steam piping 28, and inner cylinder 16. Accordingly, only the extraction steam piping 28 reacts such axial alignment loads.

On the other hand, alignment loads in a transverse direction are reacted first upon the alignment lugs 34*c* and 34*d*. Thereafter, such loads are subsequently transmitted, in turn, through the load plate 30, flex plate 32 and extraction steam piping 28 or pair of flex plates 32 (depending upon the particular configuration of the steam turbine 10), and inner cylinder 16. Such transverse alignment load transmission is primarily due to the orientation of the flex plate 32 since the flex plate 32 is ideally stiff in the transverse direction, but relatively flexible in the axial direction.

Because of the nature of the improved structure 12, and the configuration of its alignment load transmission means comprising the extraction steam piping 28, the load plate 30, one or more flex plates 32, and the alignment lugs 34, typical venting measures for moisture removal are inappropriate. Accordingly, and referring again to FIG. 1 as well as the detailed portion thereof shown in FIG. 5, a plurality of venting holes 40 are bored in the means 18 attached to the inner cylinder 16 for supporting the stationary blades 20.

Figure 5:
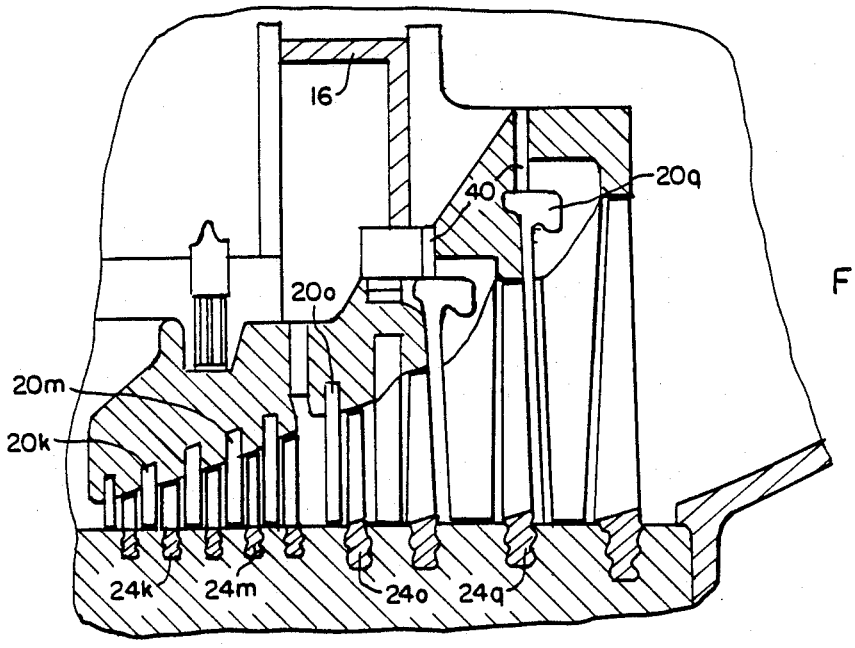
FIG. 5 illustrates an enlarged section of the steam turbine illustrated in FIG. 1.

Such venting holes 40 are arranged, in a preferred embodiment of the present invention, as four separate arrays uniformly distributed about the circumference of the stationary blade supporting means 18 between preselected ones of the rows of rotating blades 24, two such arrays at each end of the steam turbine 10. As is shown in FIGS. 1 and 5, the venting holes 40 are located after the seventh and eighth rows **24*b*, 24*c*, 24*p* and 24*q* of rotating blades 24**.

The individual sizes and number of such venting holes are selected to provide a predetermined percentage amount of flow with respect to total stage flow. For example, in one known type of steam turbine 10, approximately 0.75% of the stage flow is released as motive steam in the moisture removal process. A total number of twenty-four half-inch holes 40 are disposed approximately 14° apart radially about the means 18 attached to the inner cylinder 16 for supporting the stationary blades 20, immediately after the seventh blade rows **24*c* and 24*p*, while a total number of forty half-inch holes 40 are disposed approximately 8° apart radially about the means 18 attached to the inner cylinder 16 for supporting the stationary blades 20, immediately after the eighth blade rows 24*b* and 24*q***.

It is apparent from all of the foregoing that the present invention provides an improved steam turbine having an inner casing or cylinder structure and method of fabricating same which is simple and inexpensive to construct. The improved structure 12 according to the present invention not only provides for integrated casing alignment and steam extraction in retrofit inner cylinders in such steam turbines, but also promotes moisture removal therein.

Obviously, many modifications and variations are possible i light of the above teachings. It is to be understood, therefore, that within the scope of the appended claims the present invention may be practiced otherwise than as specifically described herein.

What we claim is:

1. In a steam turbine which includes a casing structure having an outer cylinder and an inner cylinder, means attached to the inner cylinder for supporting a plurality of stationary blades arranged in a predetermined number of annularly-shaped rows along the length of the turbine, a rotor mounted in the turbine along a longitudinal axis with a plurality of rotating blades arranged in a predetermined number of annularly-shaped rows along the length thereof and attached thereto, and extraction steam piping attached to and exiting from the inner cylinder, integrated casing alignment and steam extraction apparatus, comprising:

a load plate arranged perpendicularly to the extraction steam piping;

one or more flex plates attached between said load plate and the inner cylinder;

a plurality of alignment lugs attached in predetermined positions about said load plate; and a plurality of stiffening gussets attached both to said alignment lugs and to said load plate.

2. The integrated casing alignment and steam extraction apparatus according to claim 1, further comprising a flange fitted about the extraction steam piping and attached to said load plate.

3. The integrated casing alignment and steam extraction apparatus according to claim 1, wherein said load plate comprises a substantially diamond-shaped form with a first pair of diagonally-opposed corners of said form disposed along the longitudinal axis, and a second pair of diagonally-opposed corners of said form disposed transversely across the longitudinal axis.

4. The integrated casing alignment and steam extraction apparatus according to claim 3, wherein each of said first and second pairs of diagonally-opposed corners of said form have attached thereto a respective one of said plurality of alignment lugs.

5. The integrated casing alignment and steam extraction apparatus according to claim 4, wherein each of said plurality of stiffening gussets is attached to a respective one of said plurality of alignment lugs.

6. The integrated casing alignment and steam extraction apparatus according to claim 4, wherein at least one of said plurality of stiffening gussets is attached between its respective one of said plurality of alignment lugs and one of said one or more flex plates.

7. The integrated casing alignment and steam extraction apparatus according to claim 6, wherein said at least one of said plurality of stiffening gussets is attached to said load plate along the longitudinal axis.

8. The integrated casing alignment and steam extraction apparatus according to claim 1, wherein said one or more flex plates is disposed transversely across the longitudinal axis.

9. The integrated casing alignment and steam extraction apparatus according to claim 1, further comprising means for removing moisture from a flow of steam through the plurality of stationary and rotating blades.

10. The integrated casing alignment and steam extraction apparatus according to claim 9, wherein said moisture removing means comprises a plurality of venting holes bored in the stationary blade supporting means.

11. The integrated casing alignment and steam extraction apparatus according to claim 10, wherein said plurality of venting holes are disposed in arrays uniformly distributed about the circumference of the stationary blade supporting means between preselected ones of the rows of rotating blades.

12. In a steam turbine which includes a casing structure having an outer cylinder and an inner cylinder, means attached to the inner cylinder for supporting a plurality of stationary blades arranged in a predetermined number of annularly-shaped rows along the length of the turbine, a rotor mounted in the turbine along a longitudinal axis with a plurality of rotating blades arranged in a predetermined number of annularly-shaped rows along the length thereof and attached thereto, and extraction steam piping attached to and exiting from the inner cylinder, a method of fabricating integrated casing alignment and steam extraction apparatus, comprising the steps of:

(a) providing a load plate of substantially diamond-shaped form;

(b) attaching said load plate perpendicularly to the extraction steam piping with a first pair of diagonally-opposed corners of said form disposed along the longitudinal axis, and a second pair of diagonally-opposed corners of said form disposed transversely across the longitudinal axis;

(c) providing one or more flex plates;

(d) attaching said one or more flex plates between said load plate and the inner cylinder;

(e) providing a plurality of alignment lugs;

(f) attaching said plurality of alignment lugs in predetermined positions about said load plate;

(g) providing a plurality of stiffening gussets; and (h) attaching said plurality of stiffening gussets both to said alignment lugs and to said load plate.

13. The method of fabricating integrated casing alignment and steam extraction apparatus according to claim 12, further comprising the steps of:

(i) providing a flange for the extraction steam piping;

(j) fitting said flange about the extraction steam piping; and (k) attaching said flange both to the extraction steam piping and said load plate.

14. A steam turbine, comprising:

a casing structure having an outer cylinder and an inner cylinder;

means attached to the inner cylinder for supporting a plurality of stationary blades arranged in a predetermined number of annularly-shaped rows along the length of the turbine;

a rotor mounted in the turbine along a longitudinal axis with a plurality of rotating blades arranged in a predetermined number of annularly-shaped rows along the length thereof and attached thereto;

extraction steam piping attached to and exiting from the inner cylinder;

a load plate arranged perpendicularly to the extraction steam piping;

one or more flex plates attached between said load plate and the inner cylinder;

a plurality of alignment lugs attached in predetermined positions about said load plate;

a plurality of stiffening gussets attached both to said alignment lugs and to said load plate;

a flange fitted about the extraction steam piping and attached to said load plate; and means for removing moisture from a flow of steam through the plurality of stationary and rotating blades.

15. A steam turbine, comprising:

a casing structure having an outer cylinder and an inner cylinder;

means attached to the inner cylinder for supporting a plurality of stationary blades arranged in a predetermined number of annularly-shaped rows along the length of the turbine;

a rotor mounted in the turbine along a longitudinal axis with a plurality of rotating blades arranged in a predetermined number of annularly-shaped rows along the length thereof and attached thereto;

extraction steam piping attached to and exiting from the inner cylinder;

a load plate arranged perpendicularly to the extraction steam piping, said load plate of substantially diamond-shaped form with a first pair of diagonally-opposed corners of said form disposed along the longitudinal axis, and a second pair of diagonally-opposed corners of said form disposed transversely across the longitudinal axis;

one or more flex plates attached between said load plate and the inner cylinder, said one or more flex plates disposed transversely across the longitudinal axis;

a plurality of alignment lugs attached in predetermined positions about said load plate, each of said first and second pairs of diagonally-opposed corners of said form have attached thereto a respective one of said plurality of alignment lugs;

a plurality of stiffening gussets attached both to said alignment lugs and to said load plate, each of said plurality of stiffening gussets attached to a respective one of said plurality of alignment lugs;

wherein at least one of said plurality of stiffening gussets is attached between its respective one of said plurality of alignment lugs and one of said one or more flex plates, said at least one of said plurality of stiffening gussets attached to said load plate along the longitudinal axis;

a flange fitted about the extraction steam piping and attached to said load plate; and means for removing moisture from a flow of steam through the plurality of stationary and rotating blades.

16. In a steam turbine which includes a casing structure having an outer cylinder and an inner cylinder, means attached to the inner cylinder for supporting a plurality of stationary blades arranged in a predetermined number of annularly-shaped rows along the length of the turbine, a rotor mounted in the turbine along a longitudinal axis with a plurality of rotating blades arranged in a predetermined number of annularly-shaped rows along the length thereof and attached thereto, an extraction steam piping attached to and exiting from the inner cylinder, wherein the turbine is susceptible to alignment loads between the outer cylinder and the inner cylinder in directions along the longitudinal axis and transverse thereto, apparatus for transmitting the alignment loads, comprising:

a load plate arranged perpendicularly to the extraction steam piping, said load plate of substantially diamond-shaped form with a first pair of diagonally-opposed corners of said form disposed along the longitudinal axis, and a second pair of diagonally-opposed corners of said form disposed transversely across the longitudinal axis;

at least one flex plate attached between said load plate and the inner cylinder;

a plurality of alignment lugs attached in predetermined positions about said load plate, each of said first and second pairs of diagonally-opposed corners of said form have attached thereto a respective one of said plurality of alignment lugs, said alignment lugs that are attached to said first pair of diagonally-opposed corners reacting alignment loads in the axial direction and transmitting same, in turn, through said load plate, the extraction steam piping, and the inner cylinder, and said alignment lugs that are attached to said second pair of diagonally-opposed corners reacting alignment loads in the transverse direction and transmitting same, in turn, through said load plate, said at least one flex plate, the extraction steam piping, and the inner cylinder;

a plurality of stiffening gussets attached both to said alignment lugs and to said load plate, each of said plurality of stiffening gussets attached to a respective one of said plurality of alignment lugs;

wherein at least one of said plurality of stiffening gussets is attached between its respective one of said plurality of alignment lugs and said at least one flex plate, said at least one of said plurality of stiffening gussets attached to said load plate along the longitudinal axis;

a flange fitted about the extraction steam piping and attached to said load plate; and means for removing moisture from a flow of steam through the plurality of stationary and rotating blades.

17. The alignment load transmitting apparatus according to claim 16, comprising a pair of said flex plates, each one of said pair of said flex plates attached between said load plate and the inner cylinder transverse to the longitudinal axis on opposing sides of the extraction steam piping.

* * * * *